United States Patent [19]

Evensen

[11] 4,435,815

[45] Mar. 6, 1984

[54] METHOD AND APPARATUS FOR CHARGING A FURNACE

[75] Inventor: Knut Evensen, Oslo, Norway

[73] Assignee: Elkem a/s, Oslo, Norway

[21] Appl. No.: 368,396

[22] Filed: Apr. 14, 1982

[30] Foreign Application Priority Data

Apr. 27, 1981 [NO] Norway ..... 811425

[51] Int. Cl.[3] ..... F27D 3/10

[52] U.S. Cl. ..... 373/81; 414/162

[58] Field of Search ..... 373/81, 79; 414/162, 414/167, 180, 183, 185, 199; 266/176

[56] References Cited

U.S. PATENT DOCUMENTS 3,835,232 9/1974 Marchner ..... 373/81

3,945,515 3/1976 Busbach ..... 414/162

*Primary Examiner*—Roy N. Envall, Jr.

*Attorney, Agent, or Firm*—Eyre, Mann, Lucas & Just

[57] ABSTRACT

The invention relates to a method and apparatus for charging an electric smelting or reduction furnace. In accordance with the invention, a charge tube movable within the roof or smoke hood of the furnace and is normally held in a protected position therein. When charging of the furnace is desired, the charge tube is lowered into the furnace to serve as a means for channeling charge material into the furnace. Preferably, the charge tube is operative to accumulate charge material while in its protected position and to release the material as it is lowered toward the furnace pot.

13 Claims, 2 Drawing Figures

20
17
19
18
21
21
26
6
14
14
22
22
6
14
7
15
15
7
1
15
11
13
12
13
8
12
16
9
2
10
5
23
25
4
24
3

METHOD AND APPARATUS FOR CHARGING A FURNACE

The invention relates to a method and apparatus for charging an electric smelting or a reduction furnace. It particularly relates to the charging of typical furnaces where a charging tube projects downward through the smoke hood of an open furnace or through the furnace roof of a closed furnace.

Conventionally, furnaces are charged with batches of charge material through a stationary or rotatable charge tube which projects downwardly into the furnace pot and terminates in the area above the charge level in the pot. In these furnaces, the charge tube is constantly exposed to the extreme heat of the furnace environment and consequently the service life of the tube is relatively short.

A known method for increasing the service life of the charging tube is the cooling of the lower part of tube to reduce the thermal stress. While this known method is workable, the typical thermal exposure of the lower part of the tube is so high that it is difficult to circulate sufficient volumes of coolant to mitigate the effects of the intense heat and further there is always the risk of leakage of coolant into the furnace pot as the coolant pipes deteriorate.

It has also been found in the known methods and apparatus for charging these furnaces that since the charging tubes are open to the atmosphere air is introduced into the furnace and furnace fumes may escape into the surroundings through the charging tube. The location of the charging tube and the introduction of air into the furnace has been found to reduce the efficiency of venting in an open furnace and can cause an increased carbon consumption as the reduction of material in the charge surface is exposed to the air.

In accordance with the invention, the disadvantages of the known arrangements may be significantly overcome by a method and apparatus for charging a furnace through a charging tube which is raised to a first position for receiving charge and for sealing the smoke hood or furnace roof and then lowered into a second position for discharging material into the furnace.

In the preferred embodiment of the invention, the charging tube is telescopically arranged with respect to the smoke hood on an open furnace. At the lower end of the charging tube is a plate which extends laterally with respect to the longitudinal axis of the tube to form a lower closure thereof. Immediately above this closing plate, one or more openings are disposed in the tube wall for allowing the introduction of the charge material into the furnace pot. For best results, each of the openings is closable so that the charge may be retained within the tube until the discharge operation is initiated.

In the preferred embodiment, the charging tube is moved to a first position at an upward level where the openings are disposed within the smoke hood and the smoke hood forms a closure for the opening in the tube.

The charging tube is preferably telescopically arranged inside a guide tube disposed the smoke hood. For best results this guide tube has an inner diameter at the lower end which is larger than the outer diameter of the charging tube so as to provide an increased cross-section. When the charging tube is lowered, this increased cross-sectional area will help to initiate a vertical motion of the charge.

The bottom plate of the charge tube preferably has a circular cross-sectional area and forms a lower closure with the guide tube when the lower tube is in the upper position.

The charging tube has an internal inclined surface at its lower end which is operative to deflect the charge material into horizontal motion through the opening of the tube wall. When the tube is rotatably arranged with respect to the hood, the charge may be introduced into the furnace is any desired direction so that a controlled, evenly distributed charge level may be maintained.

During the charging, a batch of charge material is introduced into the tube while it is in the upper or closed position. Therefore, the charging tube is quickly lowered into the furnace pot to its lower position, enabling the batch to flow freely into the furnace whereupon the charging tube is again lifted to its upper position for introduction of a new batch of charge material. It will be appreciated that the charging tube may simply be lowered without charge therein and then serve as a channel for directing charge to the furnace pot.

For best results, the charging tube is allowed to drop at a high speed to provide a downwards directed motion of the charge accumulated within the tube. Preferably, immediately after the introduction of the batch into the furnace pot the tube is returned to the upper, closed position.

The significant advantage of the present invention is that the necessity for cooling the lower half of the charging tube is substantially reduced. Since the tube in accordance with the invention is in a protected position for the majority of the time, it requires only that the bottom plate be cooled.

Further, in accordance with the invention, since the smoke hood or furnace roof is sealed by the tube except for those times that the tube is lowered, only a limited volume of air is introduced into the furnace pot through the charging tube and this occurs only during the charging period, so that the venting and suction is not significantly affected. Furthermore, in closed furnaces, charging apparatus in accordance with the invention substantially prevents furnace fumes from escaping into the surroundings.

Figures 1, 2:
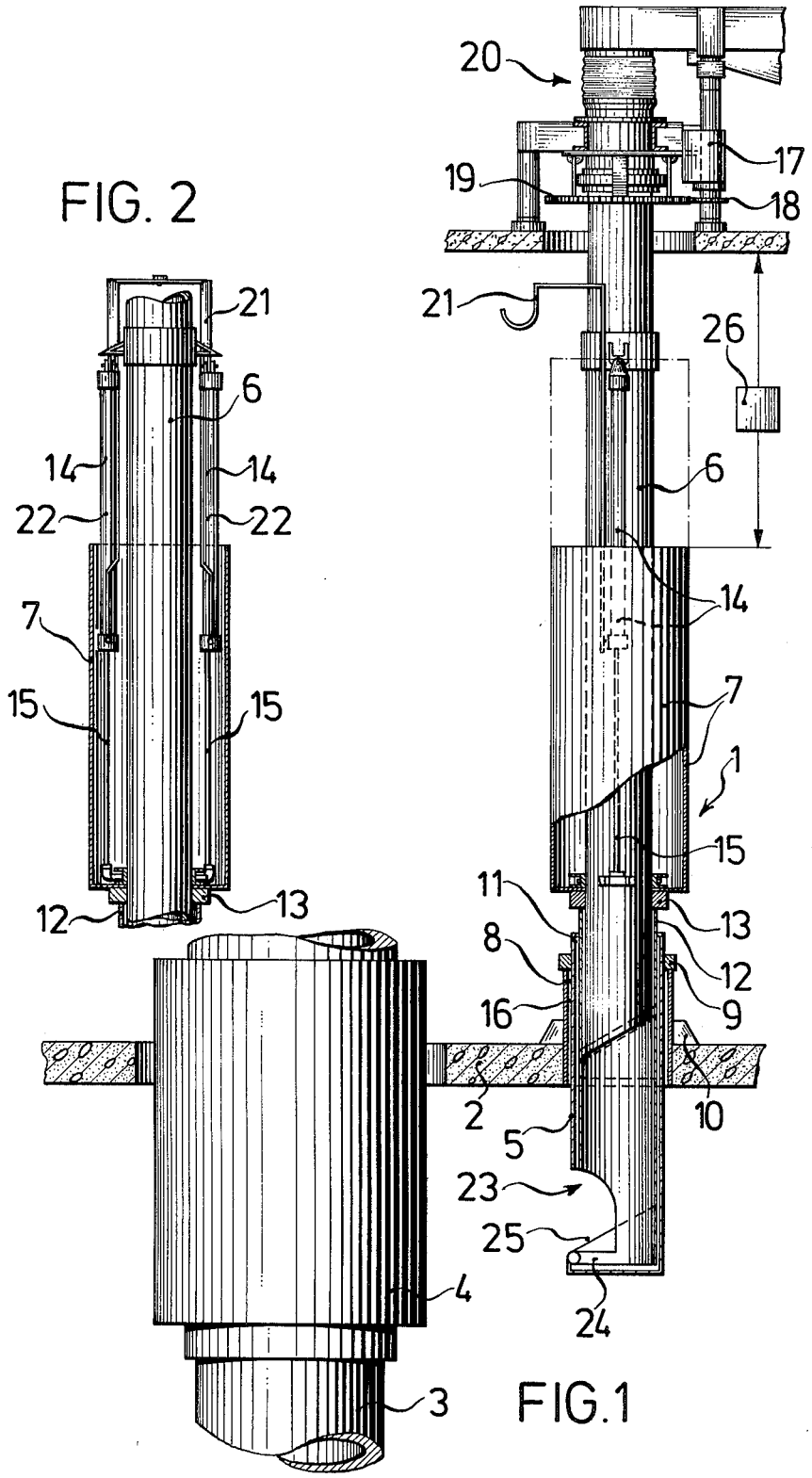
FIG. 1 shows a charging tube arranged in a typical open furnace.
FIG. 2 shows a vertical section through the middle portion of the inventive charging tube.

In FIG. 1, a charging tube 1 in accordance with the invention is arranged in an open electric smelting furnace. The entire furnace is not shown. Conventionally, such furnaces comprise a furnace pot, a smoke hook 2 arranged over the furnace pot, and a plurality of electrodes held in their electric holder assemblies. In this figure, only one electrode 3 and holder assembly 4 are shown. The electrode 3, electrode assembly 4 and the smoke hood 2 may be of any conventional type. The remaining parts of the furnace are not shown or described further since they are conventional. It will be appreciated that in a closed furnace, the smoke hood 2 is replaced by a furnace roof which encloses the pot. Since the inventive method and charging apparatus is similar in both instances, it will be described only with respect to the open furnace.

The charging tube 1 comprises a lower section 5 and an upper tube section 6. The lower tube section 5 is concentric with the upper tube section 6 and is slideably disposed externally thereto.

For best results, protection shield 7 surrounds upper tube section 6. Shield 7 is desirable to prevent excessive heating of the charging tube 1 by the induction currents imposed by the current supply to the electrodes 3.

The lower tube section 5 is slideably mounted in guide tube 8 which, preferably, is formed as an integral part of the smoke hood 2. At the upper end of guide tube 8 is disposed sealing means 9 for slidingly sealing tube section 5 therein. If desired, additional sealing means may also be disposed at the lower end of guide tube 8. As illustrated, the tube 8 is suitably reinforced by ribs 10. At the upper end of lower tube section 5, sealing means 13 provides a seal between the lower tube section 5 and the upper tube section 6.

Any conventional means for rigidly inter-connecting the protection shield 7 and the lower tube section 5 may be used. The connection means preferably additionally forms the point of attachment for the pistons 15 of a plurality of hydraulic cylinders 14 which are arranged between the protection shield 7 and the upper tube section 6, for raising and lowering tube section 5. One end of the hydraulic cylinders 14, which may be of conventional type, are rigidly connected to the upper tube section 6 while the corresponding hydraulic pistons 15 are connected at their lower end to the connection means between shield 7 and tube section 5. At the lower end of upper tube section 6 and between sections 5 and 6 there is disposed a guide ring 15. The sealing means 9 together with the sealing means 13 and guide ring 16 serve to guide the lower tube section 5 during its vertical movement.

Preferably, the lower tube 5, the upper tube 6, and the protection sheild 7, all rotate together as a unit. Means interconnecting the tubes 5 and 6 to enable such rotation are not shown. It will be appreciated that only the guiding and sealing means 9 is intended to be subjected to relative rotational motion. The required rotation may be imparted by conventional means such as motor 17 driving geared wheel 19 disposed at the upper end of tube section 6 through pinion 18.

Charge material is suitably supplied to the charge tube 1 by means such as a vibrating conveyer and/or of flap valve arranged for feeding into the upper end of the upper tube section 6.

Opening 23 in the side of lower tube section 5 is disposed opposite inclined surface 25. The surface 25 is suitably formed by rib members 24. It may also be a plate supported by the rib members.

In accordance with the invention, only the lower portion 12 of tube section 5 need be cooled. This may be suitably accomplished through cooling conduits (not shown) (in the tube wall 5). Conventional coolants such as oil or water may suitably be circulated through the conduits.

FIG. 2 shows in greater detail a vertical section through upper tube section 6 and the protection shield 7. Conduits 21 and 22 from the supply and return conduits for supplying and returning hydraulic fluid to each cylinder 14 for lifting and lowering tube section 5. Conduits 21 and 22 communicate with a conventional hydraulic pressure pump (not shown) in known manner.

During operation, charge material is fed in batches in the furnace pot. The charging tube 1 is initially raised to its upper, closed position as indicated by dotted lines of FIG. 1. Since in this position, tube section 5 is drawn into the hood 2, guide tube 8 forms an outer closure for the opening 23. Charge material is added to charge tube 1 and is contained therein until charging is desired. When charging of the furnace pot is desired, tube 1 is rotated by means of motor 17 to the position where charge material may be discharged into the pot in the desired direction from opening 23. By suitable application of pressure in cylinders 14, the lower tube section is lowered to its lower position where the charge material in the tube falls into the furnace pot. For best results, the lower tube section 5 is allowed to drop suddenly so as to create a sudden increase in cross-sectional area and to initiate a downward motion of the charge.

After discharge, lower tube section 5 is lifted immedately by application of hydraulic pressure at the cylinders 14 to receive a new batch of charge material. It will be appreciated, that, in accordance with the invention, for the majority of the time the charging tube is in the protected position. It should be further appreciated that the batch material may be introduced into the tube after the tube is lowered into the furnace pot instead of being accumulated in the tube 1. In such a case, the lower tube section 5 is simply lowered prior to the introduction of the charge and the charge is fed in conventional manner down the charging tube into the furnace pot. After the batch has been added to the furnace pot, tube section 5 is immediately returned to the upper position.

An additional feature of this system is that the charging tube 1 may also operate as a sensing device for measuring the charge level in the furnace pot. When lower tube section 5 is lowered to rest on the charge in the furnace pot, the charge level may be measured directly by a scale or indicator 26 which may be read by personnel or by outputting a signal to a computer for monitoring the charge rate.

It will be understood that the claims are intended to cover all changes and modifications of the preferred embodiments of the invention herein chosen for the purpose of illustration which do not constitute departures from the scope and spirit of the invention.

What is claimed is:

1. In a covered smelting furnace, an apparatus for supplying charge to the furnace through the cover, said apparatus comprising;
   (a) a charging tube having an upper section and a lower section slidable with respect to each other, said charging tube being disposed in the cover of the smelting furnace;
   (b) the lower section being slidable between a first position in which it extends through the cover into the interior of the furnace to enable discharge of material and a second position in which it is withdrawn into the cover of the furnace while the furnace is in operation.

2. The covered smelting furnace of claim 1 wherein the furnace is an open furnace and the cover is a smoke hood.

3. The covered smelting furnace of claim 1 wherein the furnace is a closed furnace and the cover is the furnace roof.

4. The apparatus of claim 1 wherein the said lower section has a closed bottom and has an opening in the side of its bottom portion for discharge of charging material.

5. The apparatus of claim 4 wherein the charging tube is rotatable with respect to said furnace pot.

6. The apparatus of claim 4 wherein the lower end of the charging tube has a transverse surface for deflecting charge from the tube through an opening in the side of the lower end of said tube.

7. The apparatus of claim 1 wherein the lower section is concentric with and slideable on said upper section.

8. The apparatus of claim 6 further comprising means for sealing said opening when said at least said lower section withdrawn into the cover.

9. The apparatus of claim 8 wherein the furnace is an open furnace having a smoke hood disposed above said furnace pot and said lower section is movable within said smoke hood, said means for sealing said opening being disposed in said smoke hood for sealing said opening when said lower section is positioned therein.

10. The apparatus of claim 1 further comprising means for measuring the travel of said lower portion.

11. A method for batchwise charging a furnace pot through a cover comprising the steps of:

(a) accumulating charge material in a charging tube having an opening therein, said charging tube being withdrawn from said furnace pot for receiving said charge material, said opening being sealed when said charge tube is in said withdrawn position;

(b) lowering at least a lower section of the charging tube through the cover and into the furnace pot, said opening being unsealed by the lowering of said tube thereby allowing the accumulated material to flow into the furnace pot through said opening; and (c) drawing said charge tube upwardly to its withdrawn position for receiving a subsequent batch of charge material.

12. The method of claim 11 wherein the step of lowering the lower portion of said charging tube includes dropping said lower section for initiating a downward motion of the accumulated charge in the tube.

13. The method of claim 11 further comprising the step of rotating the charge tube to a second position before lowering said lower section to vary the direction of an opening in said charge tube.

* * * * *